US011006755B2

(12) United States Patent
Yang

(10) Patent No.: US 11,006,755 B2
(45) Date of Patent: May 18, 2021

(54) ROCKING CHAIR

(71) Applicant: Zhejiang Hengfeng Top Leisure Co., Ltd., Wukang Town (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 0 days.

(21) Appl. No.: 16/798,528

(22) Filed: Feb. 24, 2020

(65) Prior Publication Data

US 2020/0281356 A1 Sep. 10, 2020

(30) Foreign Application Priority Data

Mar. 8, 2019 (CN) ..... 201920297889.2

(51) Int. Cl.

| | |
|---|---|
| ***A47C 3/029*** | (2006.01) |
| ***A47C 4/28*** | (2006.01) |
| ***A47C 5/10*** | (2006.01) |
| ***A47C 4/00*** | (2006.01) |

(52) U.S. Cl.

CPC ..... *A47C 3/029* (2013.01); *A47C 4/00* (2013.01); *A47C 4/283* (2013.01); *A47C 5/10* (2013.01)

(58) Field of Classification Search

CPC ..... A47C 3/029; A47C 4/283; A47C 4/286; A47C 5/10; A47D 13/102

USPC ..... 297/32, 45, 271.6

See application file for complete search history.

(56) References Cited

U.S. PATENT DOCUMENTS

| | | | | |
|---|---|---|---|---|
| 148,648 | A * | 3/1874 | Baer | A47C 3/029 297/32 |
| 918,659 | A * | 4/1909 | Corneil | B01F 11/0017 366/210 |
| 4,047,753 | A * | 9/1977 | Uchida | A47C 3/029 297/32 |
| 5,702,152 | A | 12/1997 | Shaw | |
| 6,398,297 | B1 | 6/2002 | Cantwell | |
| 6,439,656 | B1 | 8/2002 | Liu | |
| 7,100,975 | B1 * | 9/2006 | Zheng | A47C 3/029 297/271.6 |
| 9,060,611 | B2 | 6/2015 | Grace | |
| 9,282,824 | B2 | 3/2016 | Grace | |
| 10,213,023 | B2 | 2/2019 | Yang | |

(Continued)

FOREIGN PATENT DOCUMENTS

| | | | | |
|---|---|---|---|---|
| CN | 209915467 U | * | 1/2020 | |
| CN | 2011130376 U | * | 7/2020 | A47C 3/029 |

*Primary Examiner* — Robert Canfield

(74) *Attorney, Agent, or Firm* — Thompson Coburn LLP

(57) ABSTRACT

A folding rocking chair includes two supporting portions. Each supporting portions includes a first support, a second support, a stand member, a first rocking member, a second rocking member, a first foot member and a second foot member. The stand member, the first rocking member and the second rocking member are all rotatably connected with the first support. The first foot member is rotatably connected with the first rocking member. The second foot member is rotatably connected with the second rocking member. The first foot member and the second foot member are rotatably connected with the second support. The second foot member is rotatably connected with the stand member and is slidable along the stand member. A seat member is rotatably connected with the stand member and the first foot member and is telescopically moveable.

11 Claims, 4 Drawing Sheets

(56) References Cited

U.S. PATENT DOCUMENTS

| | | | | |
|---|---|---|---|---|
| 10,368,644 | B1 * | 8/2019 | Haingaertner | A47C 4/28 |
| 10,653,244 | B2 | 5/2020 | Yang | |
| 10,874,218 | B2 * | 12/2020 | Chen | A47C 3/029 |
| 2012/0104805 | A1 | 5/2012 | Lah | |
| 2014/0232154 | A1 | 8/2014 | Chen | |
| 2019/0104850 | A1 * | 4/2019 | Frankel | A47C 4/286 |
| 2019/0110599 | A1 | 4/2019 | Grace | |
| 2020/0187653 | A1 * | 6/2020 | Tsai | A47C 4/44 |

* cited by examiner

ROCKING CHAIR

RELATED APPLICATION DATA

The application claims the benefit of Chinese patent application serial no. 201920297889.2 filed Mar. 8, 2019, the disclosure of which is incorporated by reference herein.

FIELD

The present application relates to the technical field of furniture products, and in particular to a rocking chair.

BACKGROUND

A rocking chair is a kind of chair that can rock back and forth, which can improve the quality of life and increase the fun of life and is deeply loved by the elderly. The typical rocking chair is mainly made of rattan, wood or metal. The rocking chair in the conventional technology generally includes stand members, foot members, rocking members, cross members and the like. The rocking member is of a detachable structure, and the rocking member is generally arranged in the rocking chair as a whole. Often the conventional rocking members are mounted during use and dismounted after being folded, so that the overall structure of the rocking chair is very messy and difficult to assemble.

Therefore, a technical problem to be solved by those skilled in the art at present is how to avoid the scattered structure of the rocking chair due to the detachable structure of the rocking member.

SUMMARY

An object of the present application is to provide a rocking chair which can solve the problem of the scattered structure of the rocking chair due to the detachable structure of the rocking member. According to the rocking chair, the detaching operation of the rocking member can be avoided by means of a bundle folding structure with an interrupted rocking member. The rocking chair is very convenient to unfold and fold and has a relatively small volume after being folded. In addition, the rocking chair has a novel structure with triangular structures on opposite lateral sides after the rocking chair is unfolded, which makes the product very stable.

In order to achieve the object, a rocking chair is provided as described herein. The rocking chair includes two supporting portions which are connected with each other and used for unfolding and folding the rocking chair. Any one of the supporting portions includes a first support and a stand member connected with the first support. A first rocking member and a second rocking member rotatably connected with the first support are provided on two sides of the stand member. The supporting portion further includes a first foot member rotatably connected with the first rocking member, a second foot member rotatably connected with the second rocking member and a second support arranged above the first support and rotatably connected with the first foot member and the second foot member. The second foot member is rotatably connected with the stand member and is slidable along the stand member. The supporting portion further includes a seat member which is rotatably connected with the stand member and the first foot member and is capable of telescopic movement in an axial direction.

Preferably, a first cross member, which is rotatably connected with the second support of one supporting portion located on one side and the first support of the other supporting portion located on the other side, is provided between the two supporting portions; a second cross member, which is rotatably connected with the first support of one supporting portion located on one side and the second support of the other supporting portion located on the other side, is provided between the two supporting portions; and the first cross member is rotatably connected with the second cross member.

Preferably, the seat member includes a seat member body and a telescopic member which is arranged coaxially with the seat member body and capable of telescopic movement in the axial direction of the seat member. While the two supporting portions are unfolded, the telescopic member contracts, and while the two supporting portions are folded, the telescopic member extends.

Preferably, the telescopic member is rotatably connected with the seat member by a first rivet.

Preferably, any one of the supporting portions further includes a U-shaped connecting member which is rotatably connected with the first foot member and configured to position-limit the seat member body.

Preferably, the U-shaped connecting member is rotatably connected with the first foot member by a second rivet, and the second rivet is configured to pass through the U-shaped connecting member and the seat member body and be connected with the first foot member.

Preferably, any one of the supporting portions further includes a sliding member which is rotatably connected with the second foot member and configured to slide along the stand member.

Preferably, the stand member of the supporting portion located on one side is provided with a position-limiting hole, and the supporting portion provided with the position-limiting hole further includes a position-limiting button which is connected with the sliding member and configured to extend into the position-limiting hole for position-limiting the sliding member when the supporting portion is unfolded.

Preferably, the position-limiting button is specifically a spring pin component.

Preferably, the sliding member is specifically a sleeve component, and the sleeve component is configured to fit over an outer side wall of the stand member.

Compared with the conventional technology, the rocking chair of the present application avoids the detachable structure of the rocking member which causes the structure of the rocking chair to be very messy in the process of unfolding and folding the rocking chair. Specifically, as disclosed herein, the rocking chair includes two supporting portions which are connected with each other, and the two supporting portions are used for realizing the function of unfolding and folding the rocking chair. Each of the two supporting portions includes the first support, the second support, the stand member, the seat member, the first rocking member, the second rocking member, the first foot member and the second foot member. The stand member, the first rocking member and the second rocking member are all rotatably connected with the first support. The first rocking member and the second rocking member are arranged on two sides of the stand member. One end of the first foot member is rotatably connected with the first rocking member, one end of the second foot member is rotatably connected with the second rocking member, the other end of the first foot member and the other end of the second foot member are rotatably connected with the second support, and the second foot member is rotatably connected with the stand member and is slidable along the stand member. The second support is provided above the first support, and the second support is capable of free movement along the vertical direction in the process of unfolding and folding the rocking chair. In addition, the seat member is rotatably connected with the stand member and the first foot member, and the seat member is capable of telescopic movement along the axial direction of the seat member.

In this way, while the rocking chair is folded, the second support moves upward, the first foot member and the second foot member respectively drive the first rocking member and the second rocking member to collapse, the seat member rotates relative to the first foot member and the stand member, the seat member gradually extends, and the seat member is in the longest state when the rocking chair is in a fully folded state, and the second foot member rotates relative to the stand member, and the second foot member is slidable upward along the stand member. While the rocking chair is unfolded, the second support moves downward, the first foot member and the second foot member respectively drive the first rocking member and the second rocking member to unfold, the seat member rotates relative to the first foot member and the stand member, the seat member gradually contracts, and the seat member is in the shortest state when the rocking chair is in a fully unfolded state, and the second foot member rotates relative to the stand member, and the second foot member is slidable downward along the stand member. In this way, the detaching operation of the rocking member can be avoided by means of the bundle folding structure with the interrupted rocking member. The rocking chair is very convenient to unfold and fold and has a relatively small volume after being folded. In addition, the rocking chair has a novel structure with triangular structures on opposite lateral sides after the rocking chair is unfolded, which makes the product very stable.

BRIEF DESCRIPTION OF THE DRAWINGS

In order to more clearly explain the embodiments of the present application or the technical solutions in the conventional technology, the drawings used in the description of the embodiments or the conventional technology will be briefly described below. The drawings in the following description only show some embodiments of the present application, and for those skilled in the art, other obvious embodiments may be conceived of based on the drawings and description provided.

Figure 1:
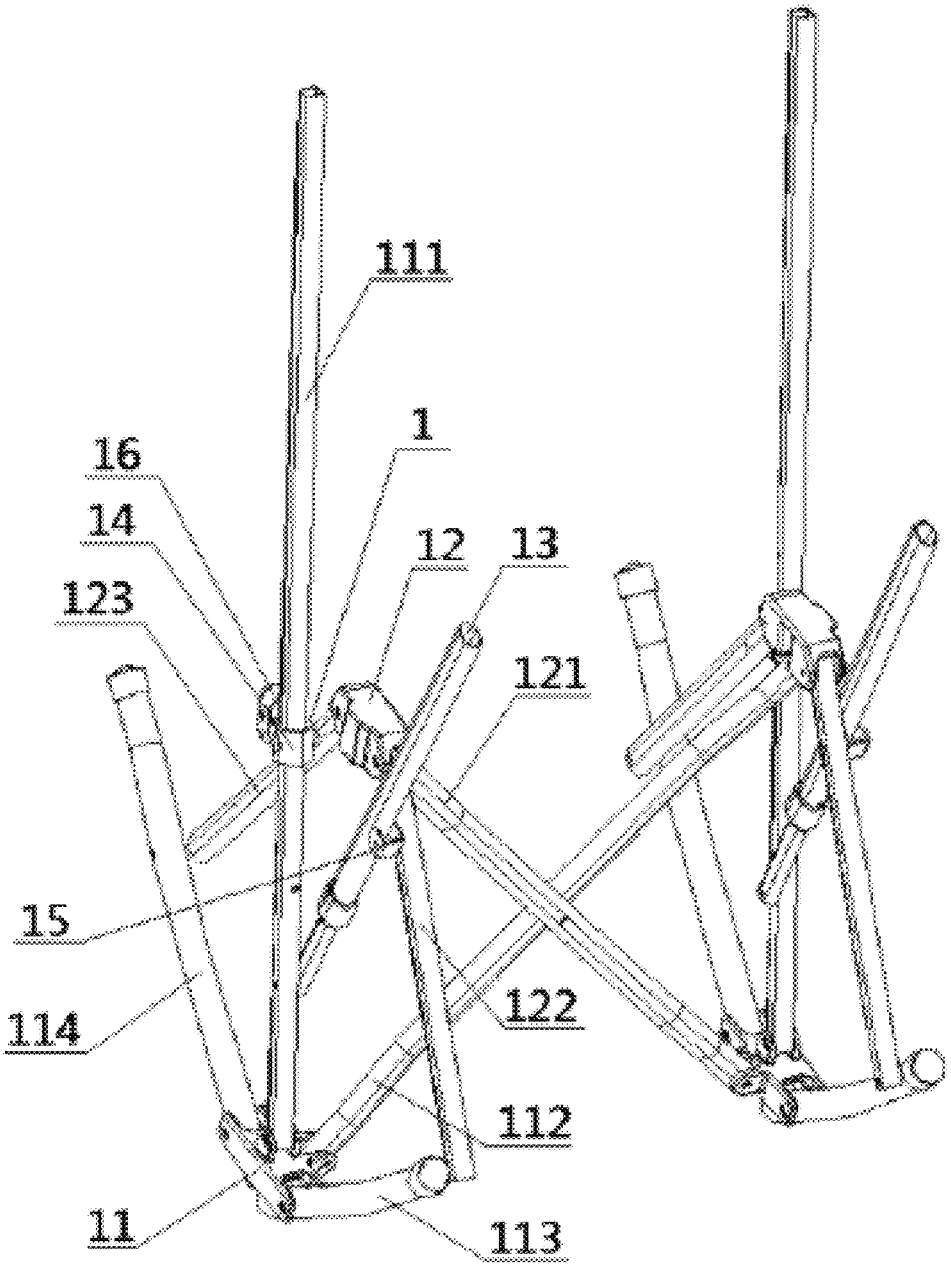
FIG. 1 is a schematic structural view of a rocking chair according to an embodiment of the present application.

Reference numerals are listed as follows:

| | |
|---|---|
| 1 supporting portion, | 11 first support, |
| 111 stand member, | 112 second cross member, |
| 113 first rocking member, | 114 second rocking member, |
| 12 second support, | 121 first cross member, |
| 122 first foot member, | 123 second foot member, |
| 13 seat member, | 131 seat member body, |
| 132 telescopic member, | 14 sliding member, |
| 15 U-shaped connecting member, | 16 position-limiting button. |

DETAIL DESCRIPTION OF THE EMBODIMENTS

While certain embodiments are described below with reference to the drawings, it should be appreciated that the described embodiments are only a part of the embodiments of the present application, rather than all embodiments, and accordingly should be viewed as illustrative rather than limiting in any sense.

An aspect of the present application is to provide a rocking chair which can solve the problem of the scattered structure of the rocking chair due to the detachable structure of the rocking member. Accordingly, the detaching operation of the rocking member can be avoided by means of a bundle folding structure with an interrupted rocking member. The rocking chair is very convenient to unfold and fold and has a relatively small volume after being folded. In addition, the rocking chair has a novel structure with triangular structures on opposite lateral sides after the rocking chair is unfolded, which makes the product very stable.

It should be noted that, the orientation terms such as "above, below, front, rear, left, right" are defined based on the drawings of the specification and not to be construed in any limiting sense.

Figure 2:
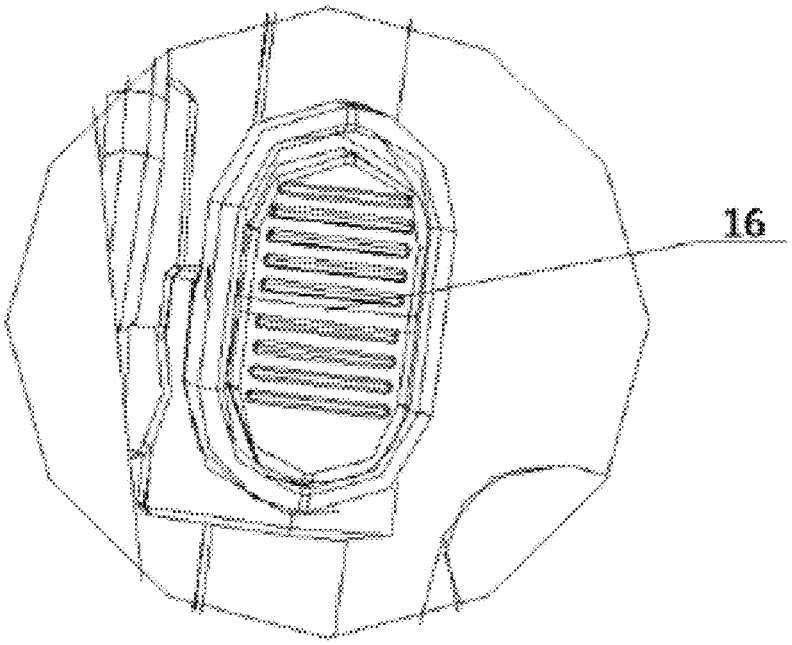
FIG. 2 is a schematic structural view of a position-limiting button shown in FIG. 1.
Figure 3:
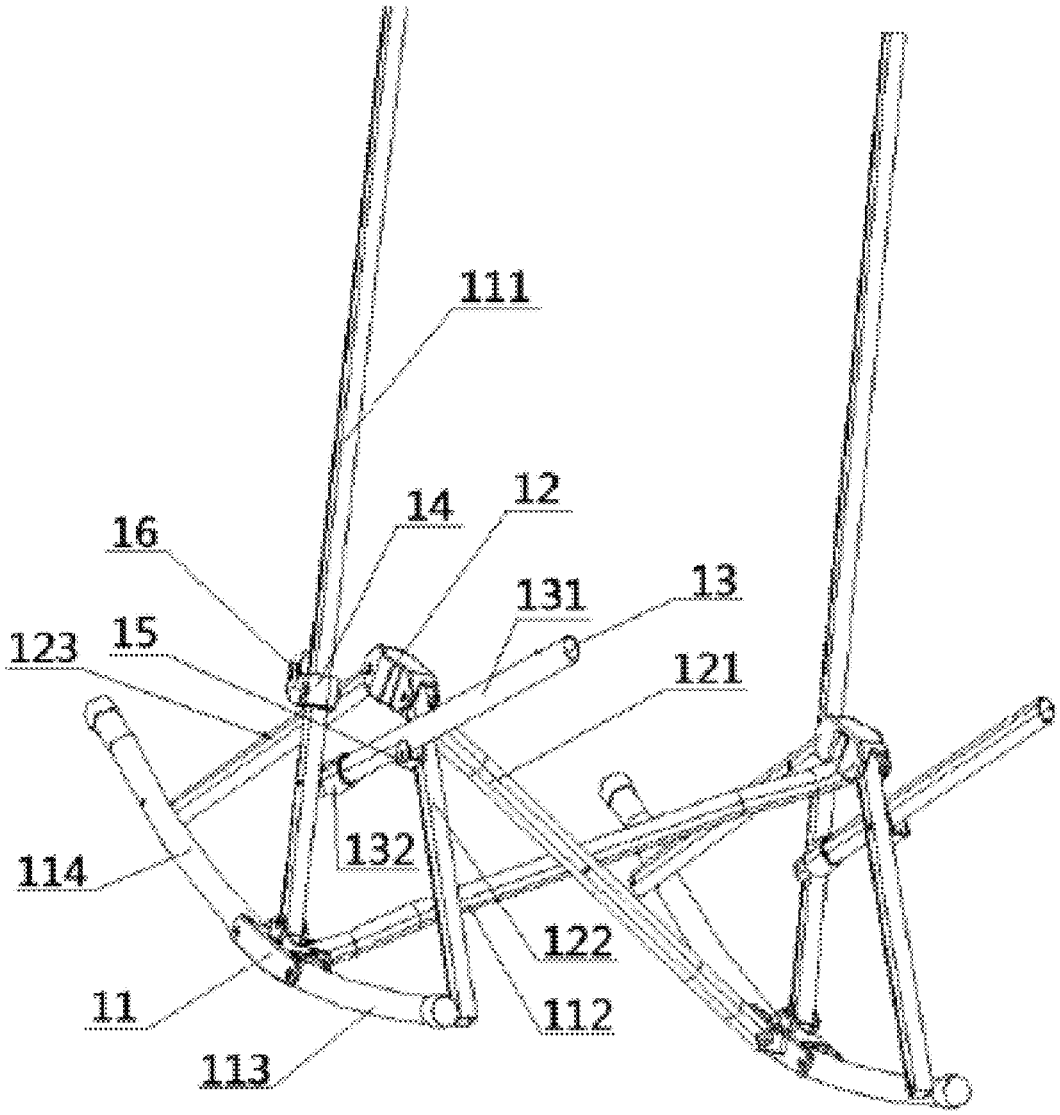
FIG. 3 is a schematic structural view of the rocking chair shown in FIG. 1 in a fully unfolded state.
Figure 4:
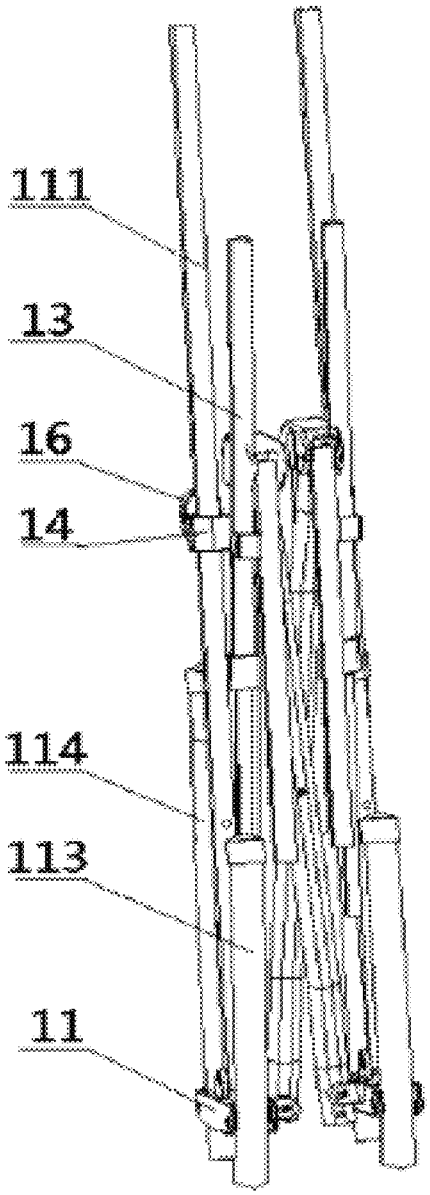
FIG. 4 is a schematic structural view of the rocking chair shown in FIG. 1 in a fully folded state.

Referring to FIGS. 1 to 4, FIG. 1 is a schematic structural view of a rocking chair according to an embodiment of the present application; FIG. 2 is a schematic structural view of a position-limiting button shown in FIG. 1; FIG. 3 is a schematic structural view of the rocking chair shown in FIG. 1 in a fully unfolded state; and FIG. 4 is a schematic structural view of the rocking chair shown in FIG. 1 in a fully folded state.

The rocking chair provided according to the present application includes two laterally spaced supporting portions 1 which are connected with each other, and the two supporting portions 1 are used for realizing the function of unfolding and folding the rocking chair. For ease of discussion only one supporting portion will be described. It should be appreciated that the opposite side is similarly constructed, except where specifically stated otherwise. Each of the two supporting portions includes a first support 11, a second support 12, a stand member 111, a seat member 13, a first rocking member 113, a second rocking member 114, a first foot member 122 and a second foot member 123.

The stand member 111, the first rocking member 113 and the second rocking member 114 are all operatively rotatably connected with the first support 11. The first rocking member 113 and the second rocking member 114 are arranged on opposite sides of the stand member 111. One end of the first foot member 122 is operatively rotatably connected with the first rocking member 113, the other end of the first foot member 122 is operatively rotatably connected with the second support 12, one end of the second foot member 123 is operatively rotatably connected with the second rocking member 114, the other end of the second foot member 123 is operatively rotatably connected with the second support 12, and the second foot member 123 is operatively rotatably connected with the stand member 111 and is slidable along the stand member 111. The second support 12 is provided above the first support 11, and the second support 12 is capable of free movement along a vertical direction in the process of unfolding and folding the rocking chair.

That is, while the rocking chair is unfolded, the second support 12 is capable of downward movement in the vertical direction, and when the rocking chair is in the fully unfolded state, the second support 12 is located at a lowest position; while the rocking chair is folded, the second support 12 is capable of upward movement in the vertical direction, and when the rocking chair is in the fully folded state, the second support 12 is located at a highest position.

Accordingly, in the process of unfolding the rocking chair, the first foot member 122 and the second foot member 123 respectively drive the first rocking member 113 and the second rocking member 114 to unfold while the second support 12 moves downward; and in the process of folding the rocking chair, the first foot member 122 and the second foot member 123 respectively drive the first rocking member 113 and the second rocking member 114 to collapse while the second support 12 moves upward.

In addition, the seat member 13 is operatively rotatably connected with the stand member 111 and the first foot member 122, and the seat member 13 is capable of telescopic movement along an axial direction of the seat member. Specifically, while the rocking chair is unfolded, the seat member 13 rotates relative to the first foot member 122 and the stand member 111, the seat member 13 gradually contracts, and the seat member 13 is in a shortest state when the rocking chair is in the fully unfolded state; while the rocking chair is folded, the seat member 13 rotates relative to the first foot member 122 and the stand member 111, the seat member 13 gradually extends, and the seat member 13 is in a longest state when the rocking chair is in the fully folded state.

In the meantime, in the process of unfolding the rocking chair, the second foot member 123 rotates relative to the stand member 111, and the second foot member 123 is slidable downward along the stand member 111. When the rocking chair is in the fully unfolded state, the second foot member 123 slides to a lowest position of the stand member 111; and in the process of folding the rocking chair, the second foot member 123 rotates relative to the stand member 111, and the second foot member 123 is slidable upward along the stand member 111. When the rocking chair is in the fully folded state, the second foot member 123 slides to a highest position of the stand member 111.

It should be noted that, only the stand member 111 on one side and the seat member 13 on the other side need to be operated to unfold or fold the rocking chair, that is, the stand member 111 of the supporting portion 1 located on one side and the seat member 13 of the other supporting portion 1 located on the other side need to be operated, or the seat member 13 of the supporting portion 1 located on one side and the stand member 111 of the other supporting portion 1 located on the other side need to be operated.

The stand member 111, the first rocking member 113 and the second rocking member 114 may all be operatively hinged to the first support 11, the first foot member 122 and the second foot member 123 may be both operatively hinged to the second support 12, while the first foot member 122 may be operatively rotatably connected with the first rocking member 113 by a rivet, and the second foot member 123 may be operatively rotatably connected with the second rocking member 114 by a rivet, wherein the technical requirements of the rivet connection may refer to the related technical requirements of the conventional technology, and will not be described herein.

In the embodiment of the present application, the rocking chair further includes a first cross member 121 and a second cross member 112. The first cross member 121 and the second cross member 112 are arranged between the two supporting portions 1. One end of the first cross member 121 is operatively rotatably connected with the second support 12 of the supporting portion 1 located on one side, and the other end of the first cross member 121 is operatively rotatably connected with the first support 11 of the other supporting portion 1 located on the other side. One end of the second cross member 112 is operatively rotatably connected with the first support 11 of the supporting portion 1 located on one side, and the other end of the second cross member 112 is operatively rotatably connected with the second support 12 of the other supporting portion 1 located on the other side.

In addition, the first cross member 121 may be operatively rotatably connected with the second cross member 112 by a rivet. Similarly, the rotary connection of the cross member and the support may be realized by hinge.

Apparently, as actually required, as shown in FIG. 1, in the supporting portion 1 located on one side, one end of the first rocking member 113 is operatively hinged to a front side of the first support 11, one end of the second rocking member 114 is operatively hinged to a rear side of the first support 11, one end of the second cross member 112 is operatively hinged to a right side of the first support 11, and one end of the stand member 111 is operatively hinged to an upper end of the first support 11; one end of the first foot member 122 is operatively hinged to a front side of the second support 12, one end of the second foot member 123 is operatively hinged to a rear side of the second support 12, and one end of the first cross member 121 is operatively hinged to a right side of the second support 12; accordingly, in the other supporting portion 1 located on the other side, one end of the first rocking member 113 is operatively hinged to the front side of the first support 11, one end of the second rocking member 114 is operatively hinged to the rear side of the first support 11, and the other end of the first cross member 121 is operatively hinged to a left side of the first support 11; and one end of the first foot member 122 is operatively hinged to the front side of the second support 12, one end of the second foot member 123 is operatively hinged to the rear side of the second support 12, and the other end of the second cross member 112 is operatively hinged to a left side of the second support 12.

In this way, while the rocking chair is unfolded, the first foot member 122 and the second foot member 123 respectively operatively hinged to the front and rear sides of the second support 12 rotate relative to the second support 12 and unfold along an outer side direction while the second support 12 moves downward, and further drive the first rocking member 113 and the second rocking member 114 to unfold; both the first cross member 121 and the second cross member 112 rotate relatively, that is, the first cross member 121 rotates counterclockwise, while the second cross member 112 rotates clockwise; and while the rocking chair is folded, the components move in opposite directions as when the rocking chair is unfolded.

With such an arrangement, the detaching operation of the rocking member can be avoided by means of the bundle folding structure with the interrupted rocking member. The rocking chair is very convenient to unfold and fold and has a relatively small volume after being folded. Besides, the rocking chair has a novel structure, and triangle structures on two sides after the rocking chair is unfolded make the product very stable.

Specifically, the seat member 13 includes a seat member body 131 and a telescopic member 132. The telescopic member 132 is arranged coaxially with the seat member body 131, and is capable of telescopic movement along an axial direction of the seat member 13, so as to realize the function of unfolding and folding the rocking chair. While the two supporting portions 1 are unfolded, the telescopic member 132 contracts, and the telescopic member 132 is in a shortest state when the rocking chair is in the fully unfolded state; while the two supporting portions 1 are folded, the telescopic member 132 extends, and the telescopic member 132 is in a longest state when the rocking chair is in the fully folded state. In addition, the telescopic member 132 is rotatably connected with the seat member 13 by a first rivet.

Furthermore, the supporting portion 1 further includes a U-shaped connecting member 15. The U-shaped connecting member 15 is operatively rotatably connected with the first foot member 122, and the seat member body 131 may be arranged in a groove of the U-shaped connecting member 15, which position-limits the seat member body 131 and further ensures the structural stability of the rocking chair.

Apparently, as actually required, the U-shaped connecting member 15 may be operatively rotatably connected with the first foot member 122 by a second rivet, that is, the second rivet passes through a left end face of the U-shaped connecting member 15, the seat member body 131 and a right end face of the U-shaped connecting member 15 successively, and is finally connected with the first foot member 122. Such an arrangement allows the seat member 13 and the U-shaped connecting member 15 to rotate relative to the first foot member 122, so as to realize the function of unfolding and folding the rocking chair.

In order to optimize the above embodiment, the supporting portion 1 further includes a sliding member 14 fitted over the stand member 111. The sliding member 14 is operatively rotatably connected with the second foot member 123 and is slidable along the stand member 111, so that the rotation of the second foot member 123 and the slide along the stand member 111 can be satisfied, thereby realizing the function of unfolding and folding the rocking chair.

More specifically, the stand member 111 of the supporting portion 1 located on one side is provided with a position-limiting hole, and accordingly, the supporting portion 1 provided with the position-limiting hole further includes a position-limiting button 16 which is connected with the sliding member 14 of the supporting portion 1. When the two supporting portions 1 are in the fully unfolded state, the position-limiting button 16 can extend into the position-limiting hole and be engaged with the position-limiting hole, so as to position-limit the sliding member 14 of the supporting portion 1, thereby ensuring the structural stability of the rocking chair.

The position-limiting button 16 and the position-limiting hole may have other different arrangements as long as the above position-limiting function can be met. For example, the position-limiting button 16 may specifically be a spring pin component. Accordingly, the position-limiting hole may be a spring pin hole that is engaged with the spring pin component. The connection between the spring pin component and the spring pin hole may refer to the related technical requirements of the conventional technology, and will not be described herein.

The sliding member 14 may have other different arrangements as long as the function of sliding along the stand member 111 can be met. For example, the sliding member 14 may specifically be a sleeve component. The sleeve component is fitter over an outer side wall of the stand member 111 and is slidable up and down freely along the stand member 111. In addition, the sliding member 14 is rotatably connected with the second foot member 123 by a third rivet.

It should be noted that, in this specification, relational terms such as first and second are only used to distinguish one entity from several other entities, and do not necessarily require or imply that any such actual relationship or sequence exists among these entities.

The rocking chair provided according to the present application has been described in detail above. Specific examples are provided in this specification to explain the principle and embodiments of the present application, and the description of the above embodiments is only used to help understand the method and core idea of the present application. It should be noted that, for those skilled in the art, improvements and modifications can be made to the present application without departing from the principle of the present application, and these improvements and modifications shall also fall into the protection scope defined by the claims of the present application.

The invention claimed is:

1. A rocking chair comprising:

two supporting portions (1) operatively connected with each other, the two supporting portions being adapted and configured to move between an unfolded position and a folded position of the rocking chair, each of the two supporting portions (1) comprising:

a first support (11) and a stand member (111) operatively connected with the first support (11);

a first rocking member (113) and a second rocking member (114), the first rocking member (113) and the second rocking member (114) being rotatably connected with the first support (11), the first rocking member (113) and the second rocking member (114) being disposed on opposite sides of the stand member (111);

a first foot member (122) operatively and rotatably connected with the first rocking member (113);

a second foot member (123) operatively and rotatably connected with the second rocking member (114), the second foot member (123) being operatively and rotatably connected with the stand member (111) and is slidable along the stand member (111);

a second support (12) arranged above the first support (1), the second support (12) being operatively and rotatably connected with the first foot member (122) and the second foot member (123); and a seat member (13) operatively and rotatably connected with the stand member (111) and the first foot member (122), the seat member (13) being adapted and configured for telescopic movement in an axial direction.

2. The rocking chair according to claim 1, further comprising:

a first cross member (121) extending between the two supporting portions (1), the first cross member (121) being operatively and rotatably connected with the second support (12) of one of the two supporting portions (1) and the first support (11) of the other of the two supporting portions (1);

a second cross member (112) extending between the two supporting portions (1), the second cross member (112) being operatively and rotatably connected with the first support (11) of the one of the two supporting portions and the second support (12) of the other of the two supporting portions;

wherein the first cross member (121) is operatively rotatably connected with the second cross member (112).

3. The rocking chair according to claim 2, wherein the seat member (13) comprises a seat member body (131) and a telescopic member (132) arranged coaxially with the seat member body (131), the telescopic member (132) being adapted and configured for telescopic movement in an axial direction of the seat member (13) in a manner such that when the two supporting portions (1) are unfolded, the telescopic member (132) contracts, and when the two supporting portions (1) are folded, the telescopic member (132) extends.

4. The rocking chair according to claim 3, wherein the telescopic member (132) is rotatably connected with the seat member (13) by a first rivet.

5. The rocking chair according to claim 4, wherein each of the supporting portions (1) further comprises a U-shaped connecting member (15) which is rotatably connected with the first foot member (122) and configured to limit a position of the seat member body (131).

6. The rocking chair according to claim 5, wherein, the U-shaped connecting member (15) is rotatably connected with the first foot member (122) by a second rivet, the second rivet passes through the U-shaped connecting member (15) and the seat member body (131) and is connected with the first foot member (122).

7. The rocking chair according to claim 1, wherein each of the supporting portions (1) further comprises a sliding member (14), the sliding member (14) is rotatably connected with the second foot member (123) and configured to slide along the stand member (111).

8. The rocking chair according to claim 7, wherein the stand member (111) of at least one of the two supporting portions (1) is provided with a position-limiting hole.

9. The rocking chair according to claim 8 wherein the sliding member (14) comprises a position-limiting button (16) configured to engage the position-limiting hole when the supporting portion (1) is unfolded.

10. The rocking chair according to claim 9, wherein the position-limiting button (16) comprises a pin urged with a spring to engage the position-limiting hole.

11. The rocking chair according to claim 7, wherein the sliding member (14) comprises a sleeve configured for sliding over an outer surface of the stand member (111).

* * * * *